United States Patent [19]

Fritz

[11] Patent Number: 4,543,889

[45] Date of Patent: Oct. 1, 1985

[54] HATCH COVER SEAL ASSEMBLY

[75] Inventor: William E. Fritz, Naperville, Ill.

[73] Assignee: Dev-Mark, Inc., Naperville, Ill.

[21] Appl. No.: 545,669

[22] Filed: Oct. 26, 1983

[51] Int. Cl.[4] ..... B61D 17/16

[52] U.S. Cl. ..... 105/377; 220/314; 49/485

[58] Field of Search ..... 105/377; 114/201 R, 114/201 A, 205; 277/246; 49/357, 485, 489; 220/314, 315, 324, 378

[56] References Cited

U.S. PATENT DOCUMENTS

| | | | |
|---|---|---|---|
| 2,141,481 | 12/1938 | Mattingley | 114/201 X |
| 2,360,276 | 10/1944 | Redmond | 114/201 A |
| 3,074,754 | 1/1963 | Komenda | 49/485 |
| 3,307,498 | 3/1967 | Stevens | 114/203 X |
| 3,401,647 | 9/1968 | Ingram | 105/377 |
| 4,248,160 | 2/1981 | Carney, Jr. et al. | 105/377 |

*Primary Examiner*—Robert B. Reeves
*Assistant Examiner*—Glenn B. Foster

[57] ABSTRACT

A cover for hopper car hatch openings as provided by railroad car and freight handling equipment. Each hatch opening is provided with a peripherial seal located out of and beneath the hatch opening and a pressure releasing latch for securing the cover against the seal and locking the cover upon the hatch openings.

4 Claims, 4 Drawing Figures

HATCH COVER SEAL ASSEMBLY

SUMMARY OF THE INVENTION

This invention relates to a "hatch cover sealing assembly" for hopper cars or trucks.

The present covers are usually constructed from an aluminium or fiber glass with the seal or sealing gasket attached thereto by adhesive or expensive structural design. The problem with these prior covers resides in their placement and design. The seals in such prior covers are normally placed beneath and within the periphery and are therefore exposed to the hatch opening. Potential contaminents adhere to the underside of the cover in the area that is radially external of the seal. Also inherent in the prior structures is the fact the seal or gasket must be compressed and by repeated compression will take a permanent set distracting from its effectiveness.

It is an object of the present invention to overcome the noted deficiencies of the prior structures. The present invention co-operates with hatch openings that are formed to provide a peripheral ring curved outwardly and downwardly of the opening, which together with an exterior gasket retainer will make up a sealing holding means. The gasket is of a singular ring configuration and of a diameter slightly less than that determined by the holding means. The gasket can be forcefully stretched until it snaps into place within the holding means where it will remain without the need of adhesives or other structural restrainers.

The present invention provides a gasket seal that is completely exterior of the hatch opening. The seal cooperates with an outer depending lip provided by the cover so that the hatch opening is in effect sealed entirely outside of its perimeter. The gasket seal of this invention is located outwardly of the hatch opening and is not attached to the underside of the cover thus leaving that surface exposed for ease in cleaning. The gasket seal of the present invention is not compressed but merely deflected and disposed between the depending lip of the cover and the gasket holding means.

Another added feature of this invention resides in the need of only a single pressure release latch rather than full diameter brace locks as previously required.

Other objects of this invention will be made apparent from the subsequent general description.

DESCRIPTION OF THE DRAWINGS

The invention will be best understood by reference to the accompanying drawings which illustrate the preferred mode of construction and arrangement of parts by which the stated objects of the invention are achieved, and in which.

GENERAL DESCRIPTION

Figure 1:
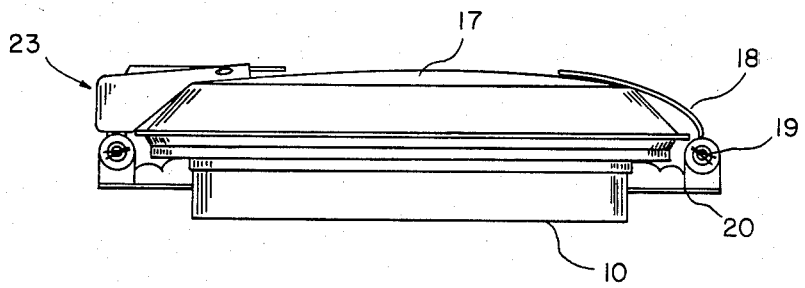
FIG. 1 is a side elevational view of the hatch opening ring and cover in latched position.

Referring to the illustrations depicting the structure of this invention the hatch opening is defined by a raised collar 10, the exposed free edge of which is flared outwardly and downwardly to provide a hatch ring 11.

On the exterior wall surface of the collar 10, positioned below and in spaced relation to the ring 11 is a gasket retainer 12. This gasket retainer 12 includes an outwardly and downwardly projecting free edge 13, that cooperates with the hatch ring 11 to form therebetween a gasket retaining area 14.

A stretchable circular gasket 15 having a set diameter equal to or slightly less than that defined by the gasket receiving area 14 is adapted to have its inner edge 16 stretched and snapped over the hatch ring 11 and into the gasket receiving area 14 as shown.

Figure 2:
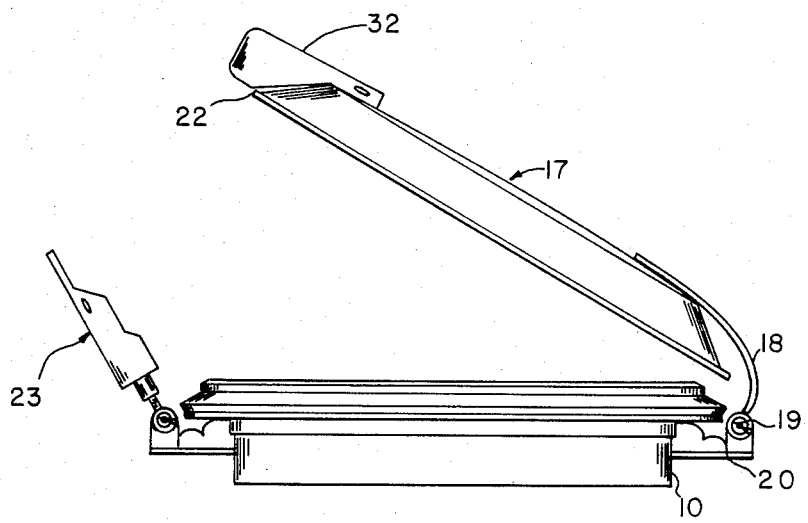
FIG. 2 is a view similar to FIG. 1 but showing the cover in an open position.

A hatch cover 17 is provided, and by a hinge strap 18 is attached to a hinge pin 19 provided by a hinge bracket 20 attached to the outer wall of the collar 10 as illustrated in FIGS. 1 and 2.

The cover 17 provides a peripheral edge flange 21 which is angularly disposed out of the normal plane of the cover 17, and which terminates into a generally radially extending lip 22.

The arcuated angle of the edge 13 of the retainer 12 is greater than that of the retained gasket 15, such that in an unlocked condition the outer edge of the set position of the gasket 15 is spaced from the edge 13 and projects into the path of movement of the flange 21 provided by the cover 17.

Figure 3:
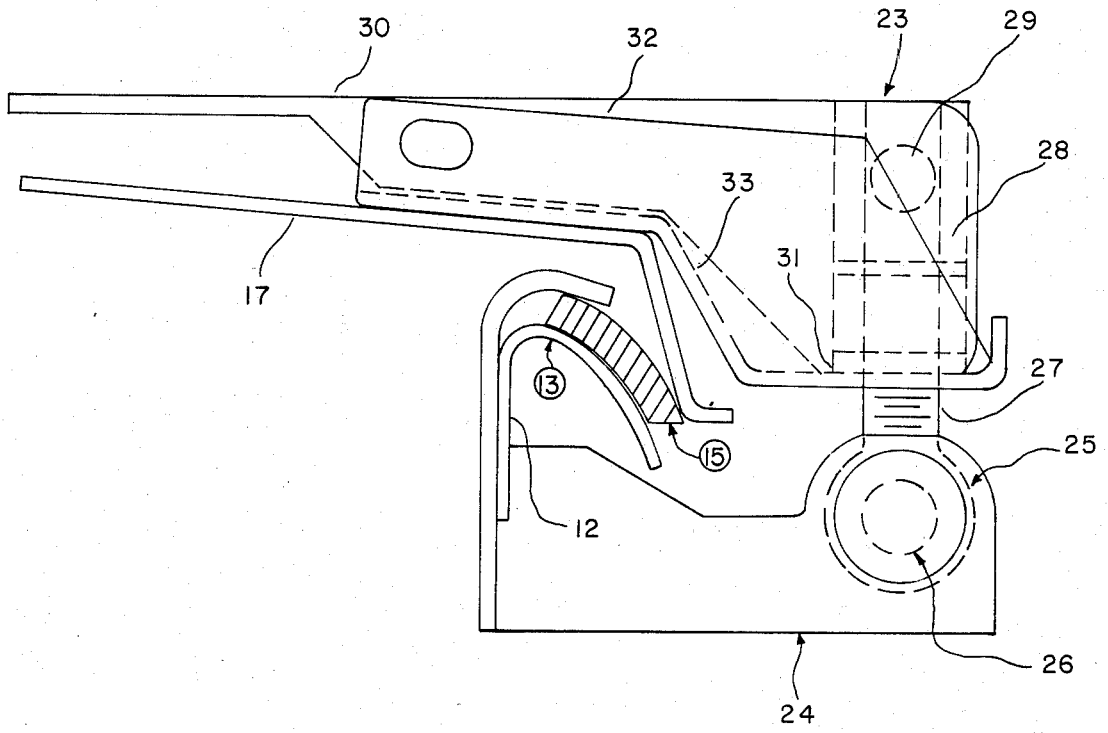
FIG. 3 is a fragmentary detailed view of the gasket seal and latch cover in a locked position.

As shown in FIG. 3 when the cover 17 is in its closed position as shown in FIG. 1 the lip 22 will have engaged the free end of the gasket seal 15 and deflected the same into contact with the depending free edge 13 of the gasket retainer 12. In this position the gasket seal 15 will have effectively sealed the peripheral edge of the cover 17 exteriorly of the hatch opening as defined by the collar 10.

It should be noted that the sealing of the cover 17 is outboard of the hatch opening as well as substantially below that of the plane of the hatch opening. Thus any and all contaminents are prevented from entering the hatch opening or from having access to the inner underside of the cover 17.

As the gasket 15 comprises a semi-flexible circular ring it can be readily replaced within the gasket retainer 12 when required.

To effectively releasably lock the cover 17 upon the collar 10 there is provided a pressure relief latch 23.

Figure 4:
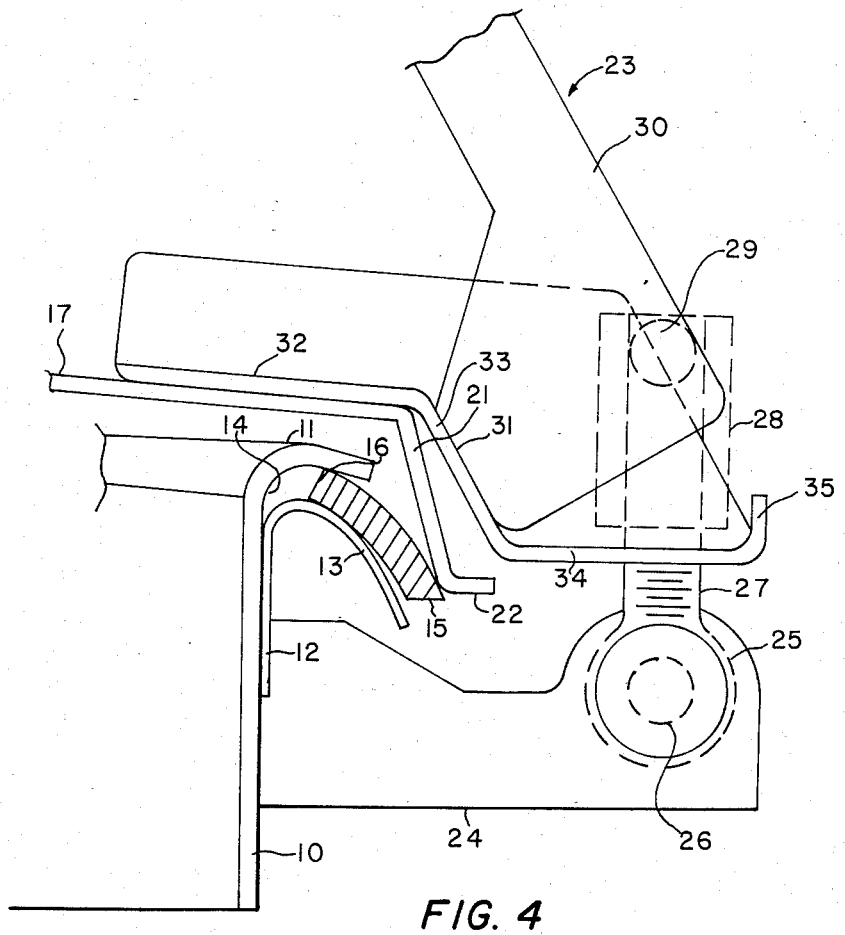
FIG. 4 is a fragmentary detailed sectional view similar to FIG. 3 but with parts in an unlatched position.

As illustrated in FIGS. 3 and 4 there is mounted on the exterior wall of the collar 10, at a point diametrically opposite to that of the hinged bracket 20, a latch bracket 24. This bracket 24 provides a pivotal mounting 25 for a latch pin 26. The latch pin 26 includes a radially extending threaded stud 27 which has mounted thereon an internally threaded sleeve 28. This sleeve 28 provides a bushing for a pivot pin 29. Mounted on the pivot pin 29 is a manually actuated latch lever 30. This latch lever 30 provides a bearing shoulder 31 which is adapted to have adjustable contact with a latch plate 32 mounted upon the cover 17.

As shown the latch plate 32 provides a tapered wall 33 which terminates into a split horizontal base 34, that in turn terminates into bifurcated retaining posts 35.

As shown in FIG. 3 when the latch lever 30 is in its latching position it will have pivoted about pin 29 so as to bring its bearing shoulder 31 into facial contact with the horizontal base 34 of the latch plate 32. In such positon the lip 22 of the cover 17 will have deflected the free end of the gasket 15 into sealing contact with free edge 13 of the gasket retainer 12. Thus the cover is latched in a sealed condition upon the hatch ring 10.

When the latch lever 30 is pivoted into a opening position the bearing shoulder 31 will first engage the tapered wall 33 of the latch plate 32 permitting partial breaking of the sealed closure allowing internal pressures to be safely released from within the hopper car. Further pivotal movement of the latch lever 30 will permit it and its associate parts to be disengaged from the cover 17 permitting it to be fully opened, as seen in FIG. 2.

To compensate for various thicknesses of gaskets as well as pivotal deflection of the cover 17 the sleeve 28 may be threaded upon the stud 27 in either direction so as to vary the displacement between the pivot pins 26 and 29. This adjustment will vary the point of contact between the peripheral flange 21 of the cover 17 with the exposed free edge of the gasket 15.

It should also be noted that the heretofore described pressure relief latch 23 has a cam movement between its bearing shoulder 31 and the tapered wall 33 and base 34 of the latch plate 32. This permits the securing of the cover 17 upon the collar 10 and permits a semi-unlocked position to relieve built up pressure within the hopper car.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. A cover and seal assembly for a hatch opening of a hopper car and the like comprising;

(a) a collar defining the hatch opening and providing an annular peripherial flared ring extending in an outwardly and downwardly direction with respect to said collar, (b) a cover for the hatch opening including a depending peripheral flange adapted to overlay in spaced relation said flared ring of said collar, (c) an annular gasket retainer mounted on the exterior of said collar below and in spaced relation to said flared ring so as to provide therebetween a gasket receiving area and, (d) a stretchable ring gasket having an inner diameter less than the outer diameter of said flared ring of said collar and adapted to be snapped over said flared ring into said gasket receiving area so as to be held between said flared ring and said flange with its outer peripherial edge normally disposed beyond said flared ring and in the path of movement of said flange of said cover when said cover is moved into an overlying position with respect to said flared ring so as to be deflected into a hatch sealing position between said gasket retainer and said flange of said cover.

2. A cover and seal assembly as defined by claim 1 including a hinge for connecting said cover to said collar.

3. A cover and seal assembly as defined by claim 1 including a latch for locking said cover upon said collar, with said flange of said cover in sealing contact with said gasket.

4. A cover and seal assembly as defined by claim 3 wherein said latch includes a cam means arrangement that permits a partial opening of said cover relative to said collar and gasket, as well as a full lock position.

* * * * *